US005962963A

United States Patent [19]

Hooghordel

[11] Patent Number: 5,962,963

[45] Date of Patent: Oct. 5, 1999

[54] COLOR CATHODE RAY TUBE COMPRISING AN IN-LINE ELECTRON GUN

[75] Inventor: Rijk Hooghordel, Eindhoven, Netherlands

[73] Assignee: U.S. Philips Corporation, New York, N.Y.

[21] Appl. No.: 08/956,004

[22] Filed: Oct. 22, 1997

[30] Foreign Application Priority Data

Nov. 4, 1996 [EP] European Pat. Off. ..... 96203062

[51] Int. Cl.[6] ..... H01J 29/48

[52] U.S. Cl. ..... 313/414; 313/412

[58] Field of Search ..... 313/412, 413, 313/414

[56] References Cited

U.S. PATENT DOCUMENTS

| | | | |
|---|---|---|---|
| 4,337,409 | 6/1982 | Van Der Heijden et al. | 313/414 |
| 4,877,998 | 10/1989 | Maninger et al. | 313/414 |
| 4,890,032 | 12/1989 | Bijma et al. | 313/414 |

*Primary Examiner*—Nimeshkumar D. Patel
*Attorney, Agent, or Firm*—John C. Fox

[57] ABSTRACT

A color cathode ray tube of the in-line type has a prefocusing lens part and a main lens part. The prefocusing lens part comprises a first (G1) and a second (G2) electrode, each having apertures for passing electron beams. The apertures in the second electrode comprise a first (G2A) and a second (G2B) aperture, each being substantially stigmatic. The diameters of the apertures are different and $1.5 \leqq \varnothing G2B / \varnothing G2A \leqq 5$.

3 Claims, 3 Drawing Sheets

COLOR CATHODE RAY TUBE COMPRISING AN IN-LINE ELECTRON GUN

BACKGROUND OF THE INVENTION

The invention relates to a colour cathode ray tube comprising an in-line electron gun comprising a means for generating three electron beams, a pre-focusing lens portion which contains a first and a second electrode, said first and second electrodes each having three in-line apertures, the apertures in the second electrode being of a substantially circular or square form and a main lens.

Cathode ray tubes of the type mentioned in the opening paragraph are well-known.

In the construction of an electron gun, a number of important parameters must be taken into account, such as the beam displacement (BD). The electron gun has a number of lenses which have a convergent or divergent effect on the electron beams, one of these lenses being the pre-focusing lens, another one being the main lens. A change of the strength of the main lens causes a displacement of the beam on the display screen, this phenomenon is commonly referred to as beam displacement. Problems with the red-blue convergence occur as a result of the beam displacement. These problems adversely affect the picture quality.

OBJECTS AND SUMMARY OF THE INVENTION

It is an object of the invention to provide a cathode ray tube of the type mentioned in the opening paragraph, which enables the picture quality to be improved.

To this end, a colour cathode ray tube in accordance with the invention is characterized in that the apertures in the second electrode (G2) comprise a first part (G2A) facing the first electrode (G1), having a diameter ØG2A and a second part (G2B) behind the first part having a diameter ØG2B wherein the ratio of the diameters (G2B/G2A) ranges between 1.5 and 5.

The apertures in the second electrode are substantially round or square. This means that the dimension of the apertures are substantially equal (within 10%) in the horizontal and vertical direction. The apertures are thus substantially stigmatic. Within the scope of the invention, it has been recognized that the beam displacement, can be substantially (more than 10% and up to 30%) reduced if the apertures in the second electrode of the pre-focusing lens are in accordance with the invention.

The beam displacement is measured in the centre of the display screen by varying the strength of the main lens, for instance by varying the potential applied to the anode (last) electrode of the main lens between 20 and 30 kV, while the potential applied to the other electrode remains substantially constant, and by measuring the beam displacement of the outermost electron beams, i.e. the difference in position at, respectively, 20 and 30 kV, in the centre of the display screen. A reduction in beam displacement (BD) increase the image quality.

Preferably the ratio of the diameters ranges between 1.5 and 3. Within this range the dependence of the pre-focusing lens on deviations of flatness of the second electrode shows a minimum.

Preferably the ratio of the thicknesses of the first and second part of the apertures in the seconde electrode (dG2A/dG2B) ranges between 0.3 and 2.

BRIEF DESCRIPTION OF THE DRAWINGS

These and further aspects of the invention will be explained in greater detail by means of exemplary embodiments and with reference to the accompanying drawings, in which.

The Figures are not drawn to scale. In general, like reference numerals refer to like parts in the Figures.

DESCRIPTION OF THE PREFERRED EMBODIMENTS

Figure 1:
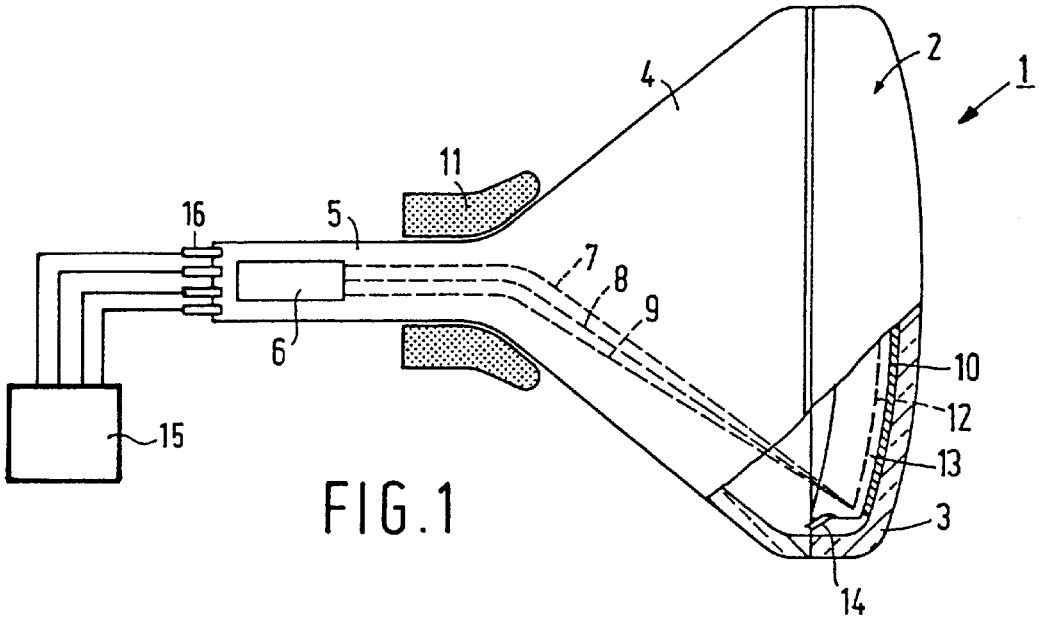
FIG. 1 is a sectional view of a display device.
Figure 2:
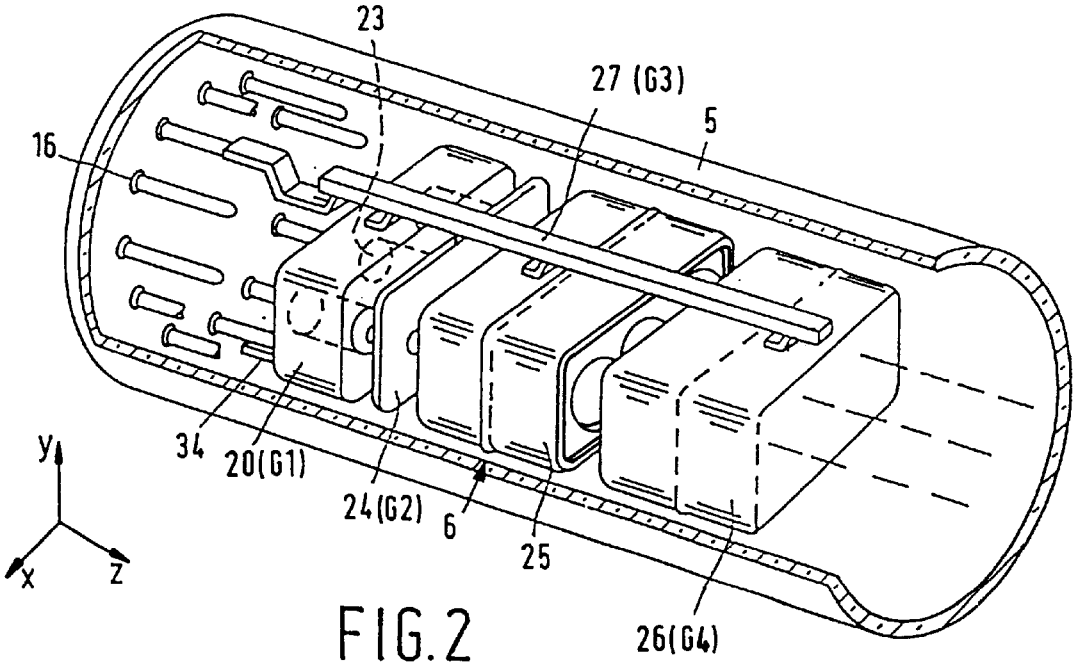
FIG. 2 is a sectional view of an electron gun.

The display device has a cathode ray tube, in this example colour display tube 1, which comprises an evacuated envelope 2 consisting of a display window 3, a cone portion 4 and a neck 5 (FIG. 1). In said neck 5 there is provided an electron gun 6 for generating three electron beams 7, 8 and 9 which extend in one plane, the in-line plane, which in this case is the plane of the drawing. A display screen 10 is provided on the inside of the display window. Said display screen 10 comprises a large number of phosphor elements luminescing in red, green and blue. On their way to the display screen, the electron beams are deflected across the display screen 10 by means of an electromagnetic deflection unit 11 and pass through a colour selection electrode 12 which is arranged in front of the display window 3 and which comprises a thin plate having an aperture 13. The colour selection electrode is suspended in the display window by means of suspension elements 14. The three electron beams 7, 8 and 9 pass through the apertures 13 of the colour selection electrode at a small angle with respect to each other and, consequently, each electron beam impinges on phosphor elements of only one colour. The display device further comprises means 15 for generating, in operation, voltages which are applied to parts of the electron gun via feedthroughs 16. FIG. 2 is a sectional view of an electron gun 6. Said electron gun comprises three cathodes 21, 22 and 23. Said electron gun further comprises a first common electrode 20 (G1), a second common electrode 24 (G2), a third common electrode 25 (G3) and a fourth common electrode 26 (G4). The electrodes have connections for applying voltages. The display device comprises leads, not shown, for applying voltages, which are generated in means 15, to said electrodes. By applying voltages and, in particular, by voltage differences between electrodes and/or sub-electrodes, electron-optical fields are generated. Electrodes G1, G2, G3 constitute an electron-optical element for generating a pre-focusing lens, electrodes 26 (G4) and sub-electrode 25 (G3) constitute an electron-optical element for generating a main lens field which, in operation, is formed between these electrodes. The electrodes are interconnected by means of connecting elements, in this example glass rods 27.

Figure 3:
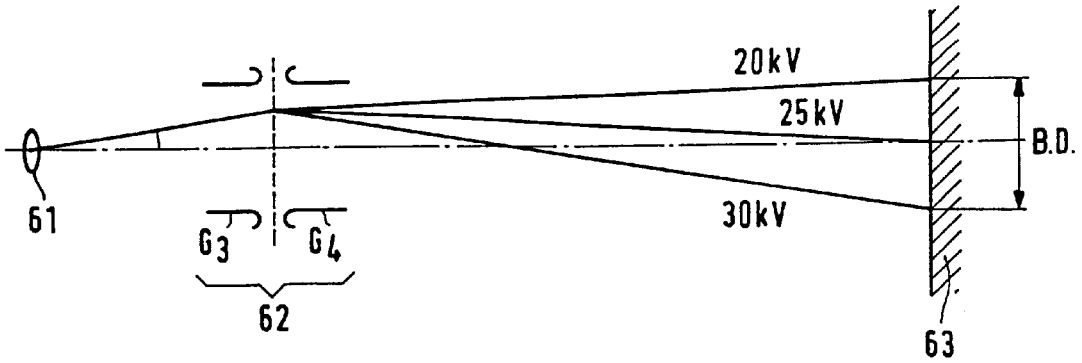
FIG. 3 illustrates the beam displacement.

The main lens, in this example formed by electrodes G3 and G4, focuses the electron beams on the display screen. Errors may occur in this focusing operation. A first error is the so-called beam displacement. FIG. 3 schematically illustrates this error. In this example, the triode and the main lens are schematically indicated by lenses 61 and 62. The electron beam eccentrically enters the main lens. If the voltage on G4 is varied (the voltages on G3 remaining the same), then the position of the electron beam in the centre of the screen 63 changes. The beam displacement BD is commonly measured as the difference in position of the electron beam on the screen, which occurs when the voltage on G4 is changed from 20 to 30 kV (kilovolts). The main reason why said beam displacement constitutes a problem is that the beam displacements of the outermost electron beams R and B are of opposite sign. Due thereto, a variation of the voltage on G4 leads to red-blue convergence errors. In practice, a variation of the voltage on G4 of several kV occurs.

Figure 4A:
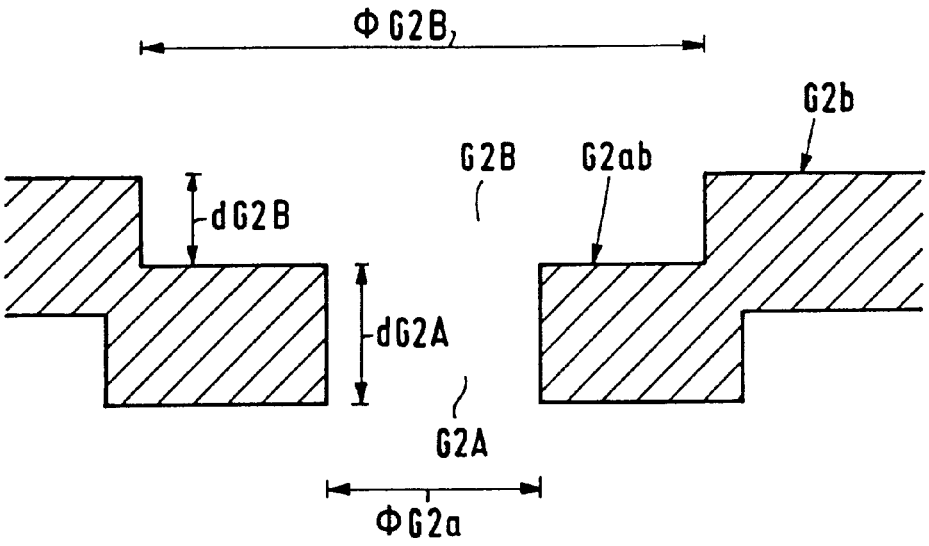
FIG. 4 is a sectional view through a G2 electrode in accordance with the invention.
Figure 4B:
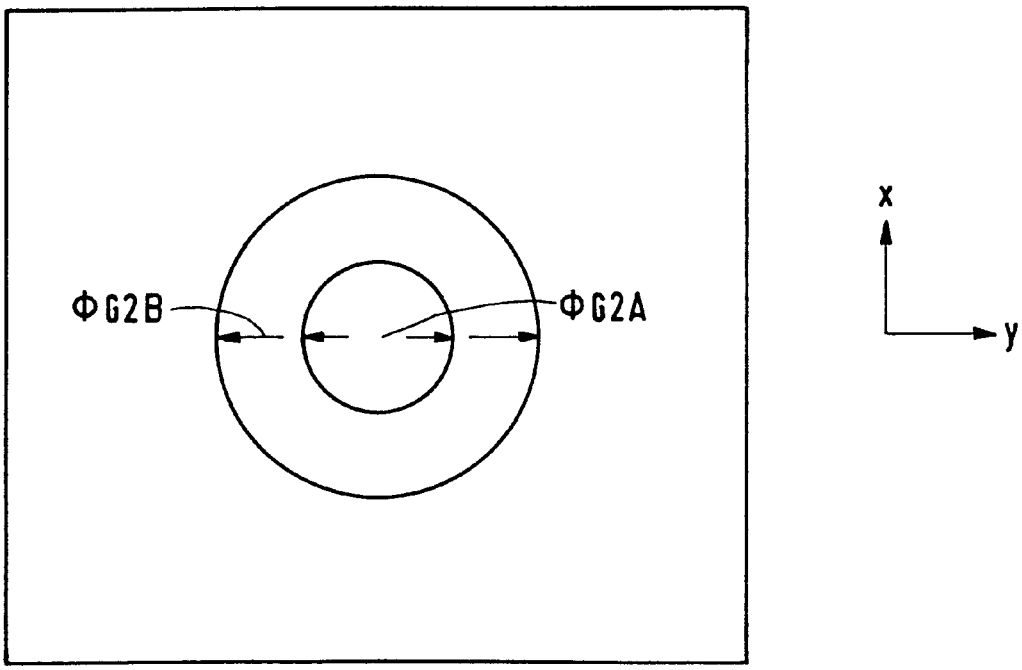

The beam displacement (BD) can be influenced, and substantially reduced by the form of the apertures in the second (G2) electrode. FIG. 4A shows a sectional view through an aperture. FIG. 4B shows a top view of an aperture of a second electrode. The apertures in G2 comprise a first part G2A, facing electrode G1 (not shown in this figure) and a second part G2B, facing electrode G3. The two parts are substantially circular or square. i.e. the dimensions in the x- and y-direction (along respectively transverse to the in-line plane) are substantially the same (meaning a differing by a amount ≦10%). In the case of a slight difference in width and/or length of the aperture, the average of the size of the aperture in the x- and y-direction is meant by the diameter Ø of the aperture. The diameter of part G2A is indicated by ØG2A, the diameter of part G2B is indicated by ØG2B. the thickness of these parts are indicated by dG2A and dG2B respectively. In this example the part G2B is formed by coining. It is also possible that the part G2A and G2B are formed by two plates, each with an aperture, placed against each other. In this example ØG2A is 0.5 mm and dG2A is 0.5 mm.

Figure 5:
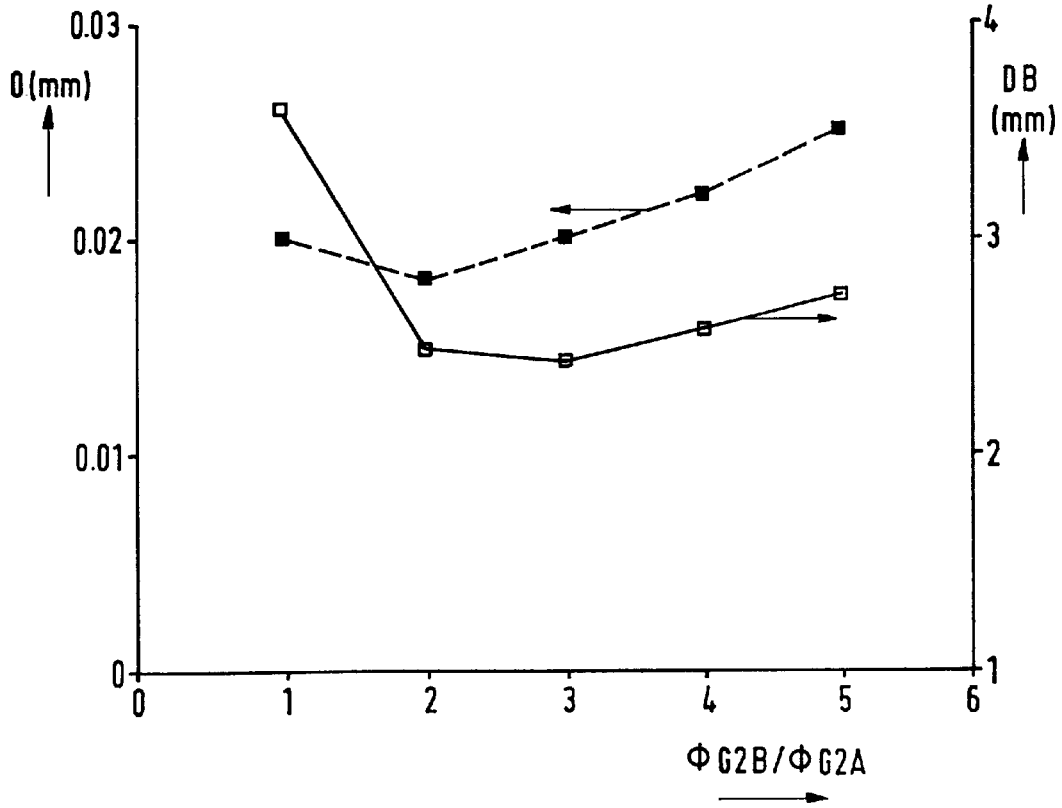
FIG. 5 graphically shows the relation between the ratio of the diameters of G2A and G2B and the beam displacement (BD) and the flatness.

FIG. 5 graphically shows the relation between beam displacement (BD) on the vertical axis (right-hand side) in mm and the parameter ØG2B/ØG2A on the horizontal axis. FIG. 5 shows that a substantially decrease in the beam displacement occurs in the range 1.5≦ØG2B/ØG2A≦5. The decrease is more than 10% and can reach values of up to approximately 30%.

FIG. 5 graphically also shows that total deviation in flatness of the side of the G2-electrode facing the G3-electrode. This flatness is composed in part of the flatness of surface G2ab and in part of the flatness G2b (see FIG. 4A). A decrease in the variations O in the total flatness leads to a decrease of image errors associated with such deviations and thus to an increase in the image quality. Preferably the ratio ØG2B/ØG2A ranges between 1.5 and 3. In this range the variations in total flatness have decreased (see FIG. 5).

In the example the ratio dG2A/dG2B is 0.5 mm/0.25 mm=2. Preferably this ratio ranges between 5 and 0.5. As the ratio is increased above or below the indicated range the positive effects of the invention become less appreciable.

Summarizing the invention relates to a colour cathode ray tube of the in-line type has a pre-focusing lens part and a main lens part. The prefocusing lens part comprises a first (G1) and a second (G2) electrode, each having apertures for passing electron beams. The apertures in the second electrode comprise a first (G2A) and a second (G2B) aperture, each being substantially stigmatic. The diameters of the apertures are different and 1.5≦ØG2B/ØG2A≦5.

It will be obvious that within the scope of the invention many variations are possible to those skilled in the art. In the example the sider of the apertures are straight, in other embodiments the sider may slightly conical. The ratio of the diameters is then measured at the transition between the first and second part.

I claim:

1. A color cathode ray tube comprising an in-line electron gun comprising a means for generating three electron beams, a pre-focusing lens portion comprising a first and a second electrode, said first and second electrodes each having three in-line apertures, the apertures in the second electrode being of substantially circular or square form and a main lens, characterized in that, the apertures in the second electrode comprise a first part, facing the first electrode, having a first diameter and a second part, behind the first part, having a second diameter, wherein the ratio of the second diameter to the first diameter ranges between 1.5 and 5 and the first aperture extends through the second aperture.

2. A color cathode ray tube as claimed in claim 1, characterized in that the ratio of the diameters ranges between 1.5 and 3.

3. A color cathode ray tube as claimed in claim 1, characterized in that, the ratio of the thickness of the first part to the thickness of the second part ranges between 5 and 0.5.

* * * * *